US006666435B2

(12) United States Patent
Blosfelds

(10) Patent No.: US 6,666,435 B2
(45) Date of Patent: Dec. 23, 2003

(54) SELF-CLOSING GATE FOR FENCE ENCLOSURES

(76) Inventor: Ivar V. Blosfelds, 21050 N. Escondido Way, Boca Raton, FL (US) 33433

( * ) Notice: Subject to any disclaimer, the term of this patent is extended or adjusted under 35 U.S.C. 154(b) by 0 days.

(21) Appl. No.: 10/055,680

(22) Filed: Jan. 23, 2002

(65) Prior Publication Data

US 2002/0095900 A1 Jul. 25, 2002

Related U.S. Application Data

(60) Provisional application No. 60/263,652, filed on Jan. 23, 2001.

(51) Int. Cl.[7] ..... E04H 17/00; E04H 4/14

(52) U.S. Cl. ..... 256/73; 256/24; 256/26; 403/326; 292/251.5

(58) Field of Search ..... 256/19, 25, 26, 256/31, 47, 65.01, 73, 21, 22, 24, 32; 403/326, 327, 329, 330; 292/251.5, DIG. 62

(56) References Cited

U.S. PATENT DOCUMENTS 4,503,723 A * 3/1985 Reid ..... 74/96
5,362,116 A * 11/1994 Doyle et al. ..... 292/144
5,664,769 A * 9/1997 Sadinsky et al. ..... 256/73
5,711,556 A * 1/1998 Masters ..... 292/251.5
6,027,104 A * 2/2000 Alexander et al. ..... 256/25
6,190,082 B1 * 2/2001 Butterfield ..... 403/325

* cited by examiner

*Primary Examiner*—Jeanette Chapman
(74) *Attorney, Agent, or Firm*—Burr & Brown

(57) ABSTRACT

A gate for fence enclosures includes a pair of spaced vertical frame members with a pair of horizontal frame members extending between and into a top and bottom end of the vertical frame members. Mesh screen is tensioned between the vertical and horizontal frame members. A pair of support members is used for each of vertical frame member with mounting plates connecting the top and bottom of each pair of support members. Hinges connect the gate to the support members and facilitate closing and opening. A latching device enables the gate to be secured to the support members.

6 Claims, 2 Drawing Sheets

SELF-CLOSING GATE FOR FENCE ENCLOSURES

FIELD OF THE INVENTION

This invention relates to the field of fence gates and more particularly to self-closing gates used with tensioned fences of the sort used as a safety barrier on residential swimming pools.

BACKGROUND OF THE INVENTION

Safety barriers are required in many states around residential swimming pools to prevent the accidental drowning of small children. Oftentimes, these safety barriers are stretched-panel fences with flexible, lightweight panels (typically nylon mesh) attached to poles slid into mounting receptacles. They can be temporarily removed when the pool is in use.

In a tensioned fencing system, the individual fence panels are linked together with latches, hooks, or clips that are effectively child-proof. The poles within an individual panel are installed to slant slightly inward, towards each other. When linked with other panels, the poles must be pulled outwardly, stretching the panel as well as imparting a force upon the portion of the pole inserted into the mounting receptacle, thereby making it very difficult to dislodge any pole. When a panel is disconnected and the tension relaxed, the poles can be easily removed and no longer function as a safety barrier.

The removal of one or two panels in a tensioned fencing system can serve the same purpose as a gate and allow swimmers access to enter and leave the pool. However, it is not a self-closing system, so the fencing system will not be secure until the poles are re-inserted and connected to the other panels.

A self-closing or auto-locking gate for tensioned fencing systems can be found in Sadinsky's U.S. Pat. No. 5,664,769. The gate employs a U-shaped frame with tensioned mesh within the frame. One side of the gate is attached to a pair of support poles while an opposite side of the gate is latched to an additional pair of support poles. The support poles are initially slanted inwardly towards the gate but which achieve vertical alignment when connected to the fence and subsequently reacts to the tension of the fence. The support poles absorb the fence tension without transferring that tension to the gate. Thus, the fence tension is required to achieve proper alignment and facilitate auto-locking. If panels near the gate are disconnected while cleaning the pool, then the tension on the support poles will be reduced and the support poles will no longer be in vertical alignment. The resulting inward force will be absorbed by the U-frame or by the latch. The potential for the frame or latch bending is increased as is the likelihood of misalignment and failure of the auto-locking capability.

A further limitation in this type of gate is the lack of rigidity or strength in the gate's U-frame. In typical operation, it is likely that adults, teenagers, or a plurality of children will eventually expose the gate to forces greater than those achieved by a 70 pound child or the gate's maximum limit. The result in exceeding this limit will be the compromise of the frame's integrity. The warped or bent frame will create such misalignment as to prevent the gate from closing or opening.

An additional limitation in this type of gate is the employment of round support and framing members, increasing the possibility of members rotating out of alignment over time. Each time the gate is vigorously opened, pressure is put on the support poles. Brackets connecting the support poles to one another to oppose this force but continued operation risks the rotation of the round support poles within the brackets and the associated misalignment. Without diligent adjustments and maintenance, the resulting misalignment can prevent the gate from properly functioning in its self-closing capacity.

Accordingly, there is a need to provide a reliable self-closing safety gate that can maintain its safety features under all operating conditions.

SUMMARY OF THE INVENTION

The present invention teaches a device for improving the safety, reliability, and functionality of self-closing gating systems. The exemplary self-closing gate for fence enclosures includes a gate frame that is comprised of vertical and horizontal frame members with mesh screen tensioned between the frame members. One pair of support members includes hinges for fastening to one side of the gate frame while an additional pair of support members includes a latching device to engage the opposite side of the gate frame. Each pair of support members is connected together on the top and bottom with mounting plates.

In an exemplary embodiment of the present invention, the framing members and support members have generally square cross sections. Square members provide greater strength and rigidity than comparable round members. Importantly, this added strength enables the gate frame to withstand much greater loads without succumbing to bending or warping. This ensures that the latching device will always be able to safely secure the gate.

In an additional embodiment of the present invention, the square support members have round socket members extending from the bottom. The round socket members are inserted into the receiving holes or sockets that have been drilled into the surface surrounding the enclosure. This insures compatibility with current installation techniques within the industry.

Advantageously, the present invention can operate properly without the need for the fence system to be under tension. By solving the problem without having to rely upon the tension of the fencing system, the user can be assured that the gate can operate properly under all operating conditions. Additionally, the gate can be used with enclosures that not under tension. The present invention is a powerful solution to improving the safety and reliability of fence enclosures.

BRIEF DESCRIPTION OF THE DRAWINGS

A more complete understanding of the present invention may be obtained from consideration of the following description in conjunction with the drawing in which.

DETAILED DESCRIPTION

Figure 1:
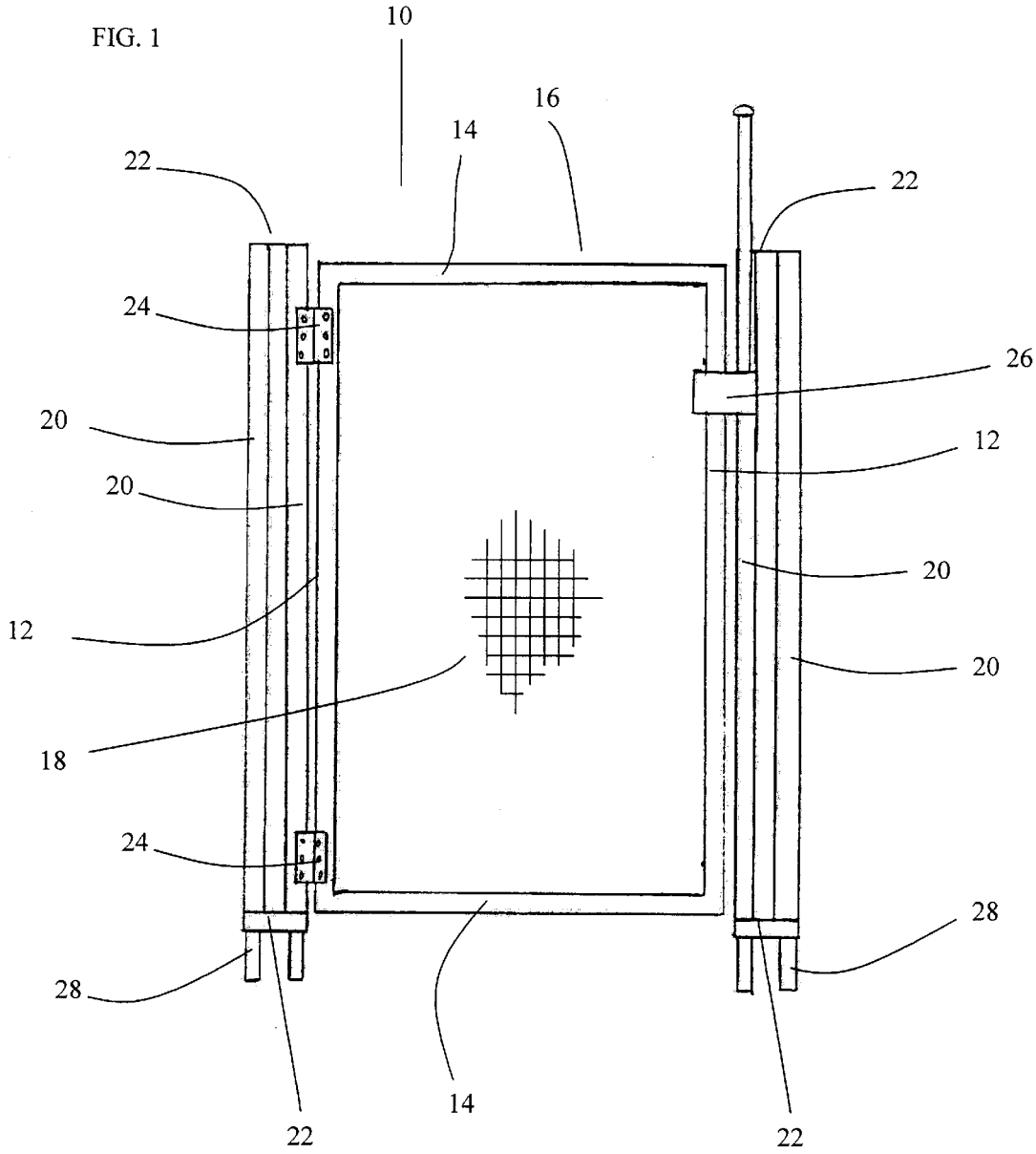
FIG. 1 is a front view of the preferred gate.

The exemplary gate for fence enclosures can be seen in FIG. 1. The gate 10 comprises a plurality of components. The components include frame members, support members, connecting means, and latching means. The components are configured to achieve the desired objective of improving the safety of fencing systems specifically and swimming pools in general.

In FIG. 1, an exemplary gate frame 16 is illustrated. A pair of vertical frame members 12 are spaced apart and connected to a pair of horizontal frame members 14. Because the strength of the present invention is a paramount concern, the preferred material for the vertical 12 and horizontal frame members 14 is aluminum although other materials exhibiting similar strength and weight attributes could be used. With aluminum, connection of the vertical 12 and horizontal frame members 14 is achieved with standard welding techniques.

The vertical 12 and horizontal frame members 14 have a generally square cross-section with a typical width of 1.25 inches and a thickness of 0.125 inches. The vertical frame member 12 has a typical length of 48 inches while the horizontal frame member 14 has a typical length of 30 inches. Although these dimensions should not be considered as limiting in any way, square stock of these dimensions is readily available and contributes to limiting the costs of the exemplary invention.

A length of mesh screen 18 is tensioned between the vertical frame members 12 and horizontal frame members 14. The mesh screen 18 is uniformly tensioned between 15 to 20 lbs. around the outside of one side of the vertical 12 and horizontal frame members 14, thereby creating a flat surface that will not provide a child with a footing on either the mesh screen 18 or the lower of the pair of horizontal frame members 14.

Two pairs of support members 20 are seen in FIG. 1. The support members 20 have generally square cross-sections with a typical width of 1.25 inches and a thickness of 0.125 inches. The support members are longer than the vertical frame members 12 to insure that the gate frame 16 has enough clearance to swing freely.

Socket members 28 are inserted into the bottom of the support members 20. When 3.0 to 4.0 inches of the socket member 28 remain extended beyond the support member 20, the socket member 28 is welded in place. With a diameter of 1.0 inches, the socket member 28 rests securely in the support member 20. Moreover, the diameter is consistent with the hole or socket diameters that are typically used when installing tensioned fences.

The support members 20 are connected in pairs by mounting plates 22. The mounting plates are welded to the top and bottom of the support members 20 as seen in FIG. 1. The mounting plates are generally rectangular in shape. A preferred size is 3.75 inches in width by 1.25 inches in height and 0.125 inches in thickness.

The preferred material for the support members 20, the socket members 28, and the mounting plates 22 is aluminum although other materials exhibiting similar strength and weight attributes could be used.

The gate frame 16 is attached to the support members 20 with at least two hinges 24. The hinges are self-closing and are attached to an inside support member 20 and a vertical frame member 12. Internal springs (not shown) within the hinge 24 exert a force that counters the opening of the gate such that the gate will automatically close when it is released.

Figure 2:
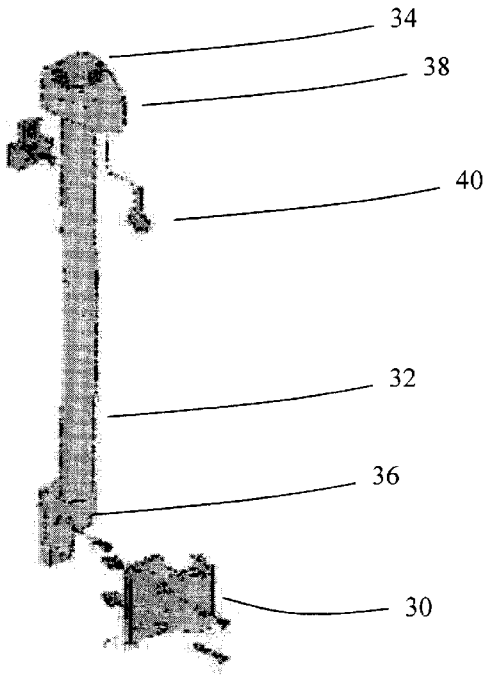
FIG. 2 is a perspective view of a latching device.

A latching device 26 is attached to the side opposite the hinges 24. The latching device 26 is shown in more detail in FIG. 2 and is comprised of a magnetic member 30 that is attached to a vertical frame member 12 (not shown), and a latching member 32 that is attached to a support member 20 (not shown). The magnetic member 30, and therefore the gate frame, is attracted to and received by a latching cylinder 36 on the latching member 32. The latching member 32 includes a release knob 34 to pull up the latching cylinder 36 and disengage the magnetic member 30. The latching member 32 can include a key mechanism 38 to enable locking of the gate with a key 40 and thereby provide additional security to the present invention. An example of a commercially available latching device 26 is the Magna-Latch® gate closure system.

In operation, the present invention would be integrated into a tensioned fencing system. The outermost support members 20 of the gate 10 would be fastened to the tensioned fence poles. The tensioned fence poles attached to the support members are not slanted inwardly relative to the other fence poles but rather vertically or slightly outwardly, thereby absorbing much of the force from the remaining fence poles. The outermost support members 20 are effectively isolated from the bulk of the tension of the fencing system, making installation and removal of the gate faster and easier. The gate operation is not impacted if the fencing system is not under tension. Fastening the gate 10 to the support members 20 provides the additional advantage of reducing the possibility of the gate being inadvertently removed or displaced by children.

It will be understood that the embodiment of the present invention specifically shown and described is merely exemplary and that a person skilled in the art can make alternate embodiments using different configurations and functionally equivalent components. All such alternate embodiments are intended to be included in the scope of this invention as set forth in the following claims.

What is claimed:

1. A gate for fence enclosures comprising:

a frame having a pair of spaced vertical frame members, a pair of rigid horizontal frame members extending between and into a top and bottom end of said vertical frame members and a length of mesh screen tensioned between said vertical and horizontal frame members;

an inner and an outer support member for each said vertical frame member with mounting plates connecting a top and bottom portion of said inner support member to a corresponding top and bottom portion of said outer support member said outer support members being fastened to tensioned fence poles of a fencing system and being isolated from the bulk of the tension of said fencing system;

a plurality of hinges secured to said inner support member on one side of said frame; and a latching device connected to an opposite side of said frame and to said inner support member.

2. A gate according to claim 1, wherein said vertical and horizontal frame members have a generally square cross section.

3. A gate according to claim 2, wherein said inner and outer support members have a generally square cross section.

4. A gate according to claim 3, further including a round socket member extending from said bottom portion of each inner and outer support member.

5. A gate according to claim 4, wherein said hinges have self-closing springs.

6. A gate according to claim 5 wherein said latch device includes a magnetic latch disposed to actuate movement of said frame to a closed and latched position.

* * * * *